US011670869B2

(12) United States Patent
Heisen et al.

(10) Patent No.: US 11,670,869 B2
(45) Date of Patent: Jun. 6, 2023

(54) PHASED ARRAY ANTENNA APERTURE AND METHOD FOR PRODUCING SAME

(71) Applicant: The Boeing Company, Chicago, IL (US)

(72) Inventors: Peter T. Heisen, Tukwila, WA (US); Raymond Say, Tacoma, WA (US)

(73) Assignee: THE BOEING COMPANY, Chicago, IL (US)

( * ) Notice: Subject to any disclaimer, the term of this patent is extended or adjusted under 35 U.S.C. 154(b) by 0 days.

(21) Appl. No.: 17/550,316

(22) Filed: Dec. 14, 2021

(65) Prior Publication Data

US 2022/0231425 A1 Jul. 21, 2022

Related U.S. Application Data

(60) Provisional application No. 63/139,223, filed on Jan. 19, 2021.

(51) Int. Cl.

| | |
|---|---|
| ***H01Q 21/00*** | (2006.01) |
| ***H01Q 3/00*** | (2006.01) |
| ***H01Q 3/36*** | (2006.01) |
| ***H01Q 21/06*** | (2006.01) |
| ***H01Q 3/26*** | (2006.01) |
| ***H01Q 3/24*** | (2006.01) |

(52) U.S. Cl.

CPC ..... *H01Q 21/0087* (2013.01); *H01Q 3/24* (2013.01); *H01Q 3/26* (2013.01); *H01Q 3/36* (2013.01); *H01Q 21/061* (2013.01)

(58) Field of Classification Search

CPC ..... H01Q 3/26; H01Q 3/36; H01Q 1/28; H01Q 1/38; H01Q 21/00; H01Q 3/24; H01Q 21/06; H01Q 21/0087; H01Q 21/061; H01P 11/006; H01P 3/16

See application file for complete search history.

(56) References Cited

U.S. PATENT DOCUMENTS

| | | | | |
|---|---|---|---|---|
| 6,653,985 | B2 * | 11/2003 | Sikina | H01Q 21/0087 343/700 MS |
| 7,889,127 | B2 * | 2/2011 | Sajuyigbe | H01Q 21/064 342/372 |
| 8,188,932 | B2 * | 5/2012 | Worl | H01Q 21/064 343/776 |
| 9,472,843 | B2 * | 10/2016 | Takeuchi | H01Q 3/26 |
| 9,761,939 | B2 | 9/2017 | Pietila et al. | |
| 10,297,923 | B2 * | 5/2019 | Chen | H01Q 23/00 |
| 2017/0229775 | A1 | 8/2017 | Navarro et al. | |

* cited by examiner

*Primary Examiner* — Vibol Tan

(74) *Attorney, Agent, or Firm* — Gates & Cooper LLP

(57) ABSTRACT

A system and method for assembling an antenna comprising an aperture plate having a plurality of aperture elements therethrough is disclosed. The method comprises forming a matrix of the at least a subset of the dielectric loads, each dielectric load having a longitudinal axis, the matrix of the at least a subset of the dielectric loads joined together by planar sacrificial interconnecting material perpendicular to the longitudinal axis of each dielectric load of the subset of dielectric loads, inserting the matrix of the at least a subset of the dielectric loads in at least a subset of the plurality of aperture elements, and removing planar sacrificial interconnecting material. Another embodiment is evidenced by an antenna produced by the foregoing steps. Multiple embodiments are disclosed.

20 Claims, 13 Drawing Sheets

PHASED ARRAY ANTENNA APERTURE AND METHOD FOR PRODUCING SAME

CROSS-REFERENCE TO RELATED APPLICATIONS

This application claims benefit of U.S. Provisional Patent Application No. 63/139,223, entitled "PHASED ARRAY ANTENNA APERTURE AND METHOD FOR PRODUCING SAME," by Peter Heisen and Raymond Say, filed Jan. 19, 2021, which application is hereby incorporated by reference herein.

BACKGROUND

1. Field

The present disclosure relates to systems and methods for producing antennas, and in particular to a system and method for producing a phased array antenna aperture having a plurality of aperture elements, each with a dielectric load inserted therein.

2. Description of the Related Art

Phased array antennas comprise a computer-controlled array of antenna elements which create or receive a beam of radio waves. The sensitive axis of a phased array antenna can be electronically steered to point in different directions without physically moving the antennas. For example, when transmitting an RF signal, the signal from the transmitter is fed to the individual antenna elements with the correct phase relationship so that the radio waves from the separate antenna elements add together to increase the radiation in a desired direction, while cancelling to suppress radiation in undesired directions. The signal from the transmitter is fed to the antennas through processor-controlled phase shifters, can programmably and electronically alter the phase electronically to steer the beam of radio waves in the desired direction. Similarly, altering the phase of the antenna elements can steer the sensitive axis of the phased array in the desired direction to receive a signal.

Phased array antennas are primarily used to transmit signals in the high frequency end of the radio spectrum, in the UHF and microwave bands, in which the antenna elements are conveniently small. Phased array antennas are typically flat and are particularly useful in mobile platforms for RF communication where low aerodynamic profiles are required. An example of a phased array antenna is presented in U.S. Pat. No. 9,761,939, by Pietila et al., which is hereby incorporated by reference. Such phased array antennas include one or more aperture plates having an array of waveguide holes that are respectively aligned to the antenna elements of the phased array. Such waveguide holes typically include a dielectric material. To achieve high gain, such antenna elements that may number in the thousands. Thus, dielectric material must be inserted into thousands of small microwave holes. This process is labor intensive and prohibitive for many applications.

What is needed is method for assembling dielectric material in aperture plates in a way that is cost effective while meeting the required close tolerances. The method described below satisfies this need.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

To address the requirements described above, this document discloses a system and method for assembling an antenna comprising an aperture plate having a plurality of aperture elements therethrough, each aperture element having a dielectric load disposed therein. In one embodiment, the method comprises forming a matrix of the at least a subset of the dielectric loads, each dielectric load having a longitudinal axis, the matrix of the at least a subset of the dielectric loads joined together by planar sacrificial interconnecting material perpendicular to the longitudinal axis of each dielectric load of the subset of dielectric loads, inserting the matrix of the at least a subset of the dielectric loads in at least a subset of the plurality of aperture elements, and removing planar sacrificial interconnecting material. Another embodiment is evidenced by an antenna produced by the foregoing steps. Multiple embodiments are disclosed.

In one embodiment, removing the planar sacrificial interconnecting material includes: milling a side of the aperture plate into which the dielectric loads are inserted to remove the planar sacrificial interconnecting material and the debris sheared from each the dielectric load. Further, each dielectric load of the at least a subset of the dielectric loads may be of a length along the longitudinal axis of greater than a depth of the each respective aperture element in the aperture plate by an length to permit debris sheared from the dielectric load upon insertion of the matrix of the dielectric loads in the plurality of aperture elements to be disposed between the planar sacrificial interconnecting material and the aperture plate before removing the matrix of dielectric loads in the plurality of aperture elements.

In a further embodiment, inserting the matrix of the at least a subset of the dielectric loads in the plurality of aperture elements includes seating each dielectric load of the at least a subset of the dielectric loads in a respective aperture element of the aperture plate and pressing the matrix of the at least a subset of the dielectric loads into the aperture plate. This pressing operation pressing may include sandwiching the matrix of the at least a subset of the dielectric loads and the aperture plate between an upper tooling plate and a lower tooling plate and pressing the at least a subset of the matrix of dielectric loads into the aperture plate until a first end of each dielectric load extends completely through the associated aperture element and contacts the lower tooling plate.

Several embodiments are disclosed with different dielectric load shapes and sizes. In one such embodiment, each dielectric load of the at least a subset of the dielectric loads includes: a cross section of slightly less than a respective dimension of the one of the aperture elements of the subset of the plurality of aperture elements into which the dielectric load is inserted at a first end of the dielectric load; and a cross section of a slightly greater than the respective dimension of the aperture element of the subset of the plurality of aperture elements into which the dielectric load is inserted at a second end of the dielectric load proximate the planar sacrificial interconnecting material. In still other embodiments, the first end of the dielectric load is chamfered to slightly less than the respective dimension of the aperture element into which the dielectric load is inserted, or the dielectric load has a draft across a length of the dielectric load. In still another embodiment, each dielectric load of the at least a subset of the dielectric loads is of a length along the longitudinal axis of greater than a depth of the respective aperture element in the aperture plate. The matrix of the at least a subset of the dielectric loads is formed by at least one of: printing; machining; and injection molding and may include a serpentine edge interadjacently matching a serpentine edge of a second matrix of a further subset of the dielectric loads.

The features, functions, and advantages that have been discussed can be achieved independently in various embodiments of the present invention or may be combined in yet other embodiments, further details of which can be seen with reference to the following description and drawings.

BRIEF DESCRIPTION OF THE DRAWINGS

Referring now to the drawings in which like reference numbers represent corresponding parts throughout.

DESCRIPTION

In the following description, reference is made to the accompanying drawings which form a part hereof, and which is shown, by way of illustration, several embodiments. It is understood that other embodiments may be utilized, and structural changes may be made without departing from the scope of the present disclosure.

Figure 1:
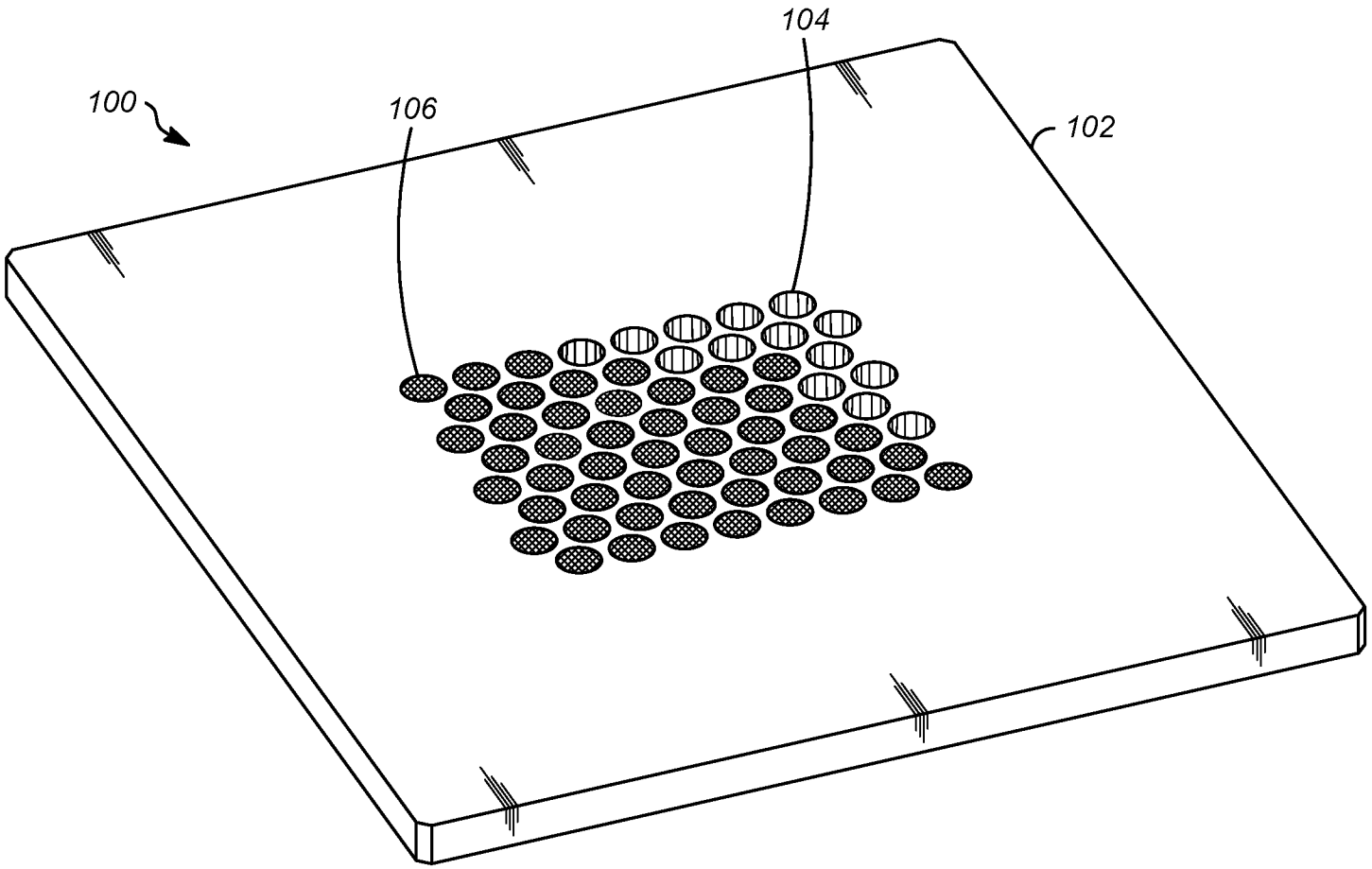
FIG. 1 is a diagram illustrating a pitch phased array antenna aperture.

FIG. 1 is a diagram illustrating a circular-waveguide-based, ½ wavelength pitch phased array (PPA) antenna aperture 100. The PPA aperture 100 comprises a plate 102 having a plurality of aperture elements 104 therethrough The PPA aperture 100 is produced by creating the aperture elements 104 in the plate 102 and inserting the dielectric material 106 (hereinafter alternatively referred to as dielectric inserts or dielectric loads) within each aperture element 104. Typically, the plate 102 is aluminum, and the aperture elements 104 are drilled through the aluminum aperture plate 102 to a diametrical tolerance on the order of +/−0.00025 inches.

The dielectric material 106 has a shape matching the interior of the aperture elements 104 and is typically formed of cross-linked polystyrene such as REXOLITE. Cross-linked polystyrene cannot typically be injection molded, so the dielectric inserts are typically machined. The diameter of the dielectric inserts is about 0.001 inches less than the aperture elements 104, to a tolerance on the order of +/−0.0005 inches. This assures a snug fit of the dielectric loads 106 into the aperture elements 104 without need for adhesive.

Once the dielectric loads 106 are formed, they are inserted into the aperture elements 104 one at a time. FIG. 1 illustrates the PPA aperture 100 before assembly is completed, as a subset of the aperture elements 104 do not yet have dielectric loads106 therein.

In some applications, the PPA aperture 100 includes thousands of aperture elements 104, each with an inserted dielectric load 106. Since the nominal diameter of the cylindrical dielectric inserts 106 is only about 0.001 inches less than that of the aperture elements 104, and no chamfers are present, the process of safely inserting the dielectric loads 106 into the apertures is time consuming. Assuming an average of 20 seconds to insert each dielectric load 106, a PPA aperture 100 having an array of 4096 elements would require about 22.75 labor hours for completion, and the expense of such manufacture is prohibitive for many applications.

Further, if a dielectric load 106 is inserted at other than perpendicular to the plate 102, the dielectric load 106 will be damaged upon insertion, because the inner edge of the harder aluminum aperture elements 104 strips off the outer surface of the softer dielectric load 106. Such damage can affect performance. For example, after the plastic inserts are installed, layers of foam and epoxy glass composite are bonded to the top of the assembly with prepreg sheet adhesive. These layers serve an electromagnetic function but also physically bond the inserts into the aluminum plate. The bonding is done under pressure, typically in an autoclave. If the plastic inserts are not sized closely to the holes, the adhesive wicks down the bores of the holes through the gap between insert and hole and contaminates the bottom surface of the plate. The bottom surface is intended as an electrical bonding surface, and the non-conductive adhesive causes problems if present.

Consequently, any damaged dielectric loads 106 must be removed and replaced. This increases cost because it increases assembly time, and because the dielectric loads 106 are expensive high precision components.

Figure 2A:
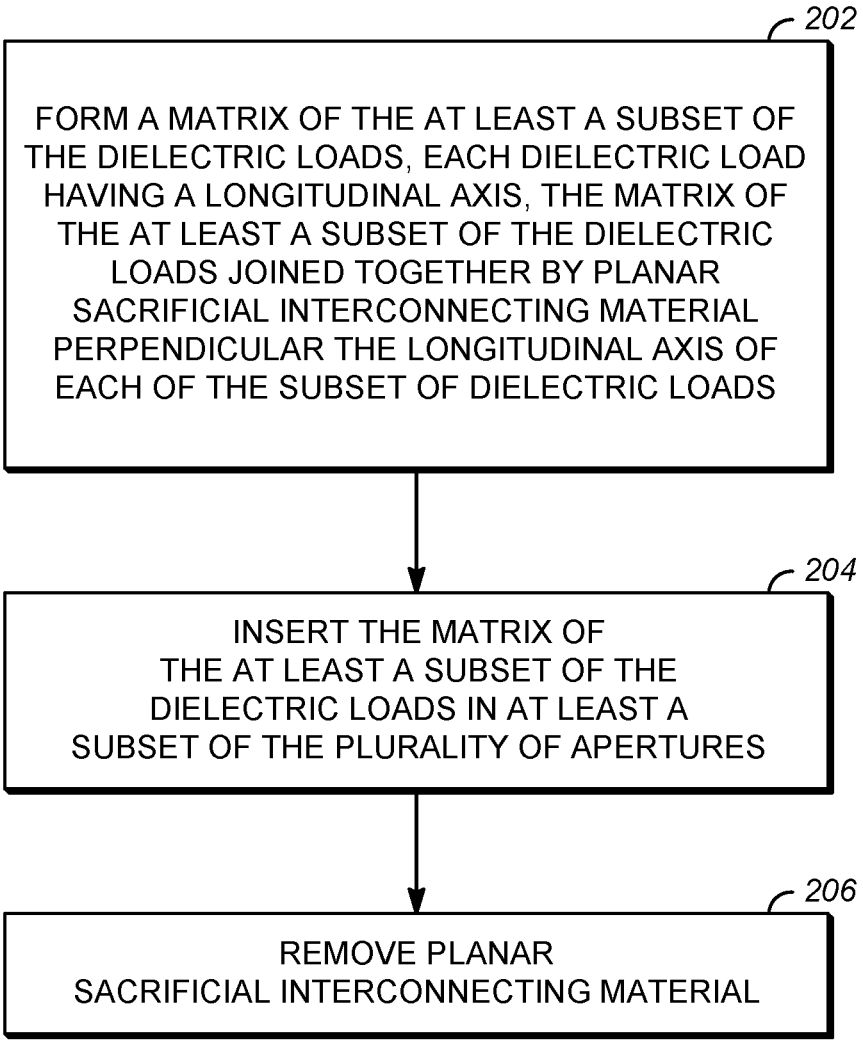
FIGS. 2A-2C are diagrams illustrating an improved technique for assembly of the phased array antenna aperture.
Figure 2B:
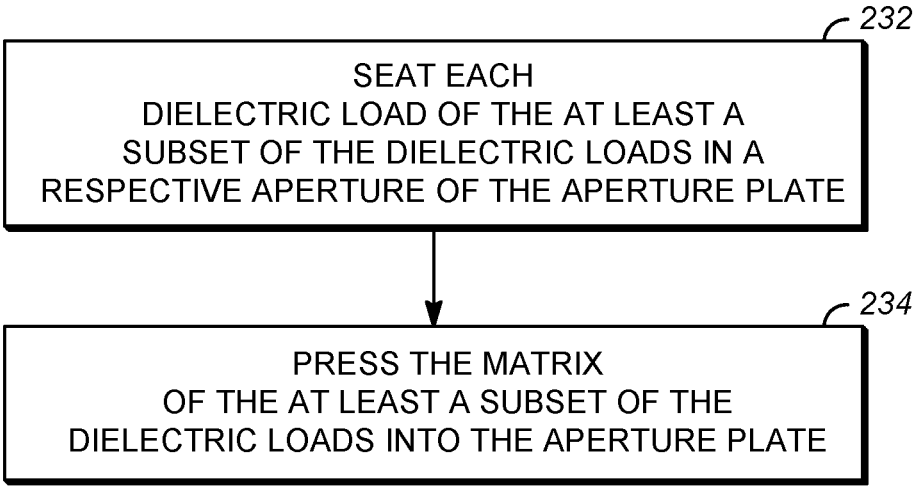
Figure 2C:
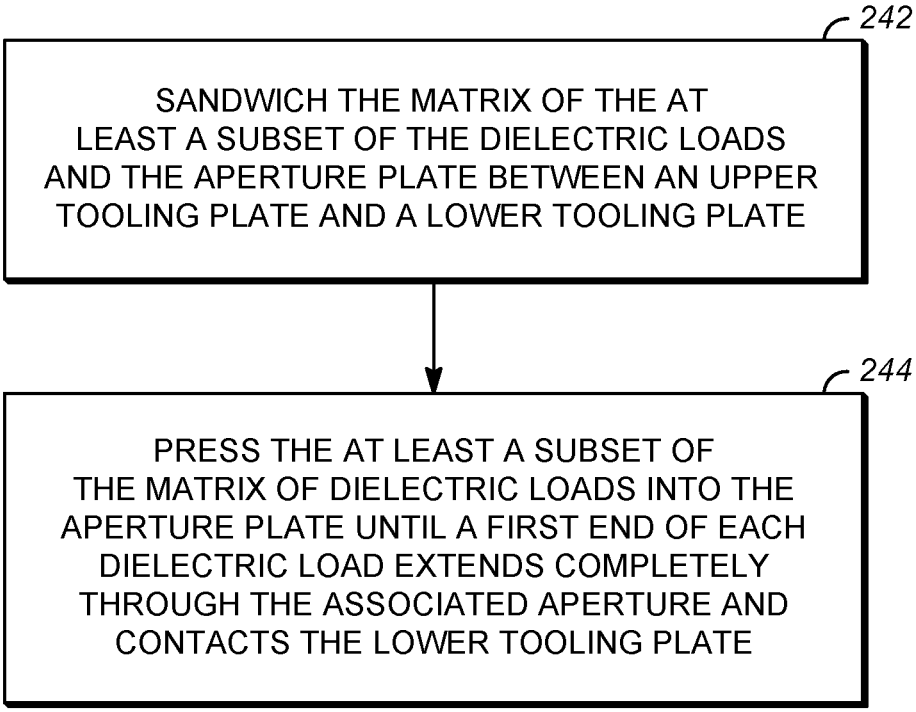

FIGS. 2A-2C are diagrams illustrating an improved technique for assembly of the PPA aperture 100. FIGS. 2A-2C will be discussed in conjunction with FIGS. 3A-3F, which visually depict the described operations. In this discussion, it is presumed that the aperture elements 104 have already been formed in the plate 102, whether by machining or other technique.

Turning first to FIG. 2A, a matrix 300 of at least a subset of the dielectric loads 106 is formed, with each of the dielectric loads 106 being joined together by a planar sacrificial interconnecting material 302 perpendicular to the longitudinal axis 304 of each dielectric load 106 in the matrix 300. This is described in block 202 of FIG. 2A and illustrated in FIG. 3A. In the illustrated embodiment, the matrix 300 comprises 16 dielectric loads 106 in a 4×4 configuration. Other shapes and numbers of dielectric loads 106 may be utilized as described further below. The term "sacrificial" refers to the notion that the material is used to hold the dielectric loads 106 in place during the assembly process but is later remove and does not contribute to the function of the PPA aperture 100 when fully assembled.

The formation of the matrix 300 can be accomplished by 3D printing using additive machining, using a material such as ULTEM 9085. Alternatively, the matrix 300 may be formed with REXOLITE 1422 and machined to shape, or injected molded using multiple grades of polyetherimide, such as ULTEM and further machined if necessary.

Returning to FIG. 2A, the matrix of the at least a subset of dielectric loads 106 is inserted into at least a subset of a plurality of aperture elements 104 in the plate 102, as described in block 204.

FIG. 2B is a diagram illustrating one embodiment of how the matrix 300 is inserted into the plurality of aperture elements 104. In block 232, each dielectric load 106 is seated in a respective aperture of the aperture plate. Then, in block 234, the matrix of the at least a subset of the dielectric loads is pressed into the aperture plate. This can be accomplished by applying a steady or impulse force along the longitudinal axis of the dielectric loads 106.

Figure 3A:
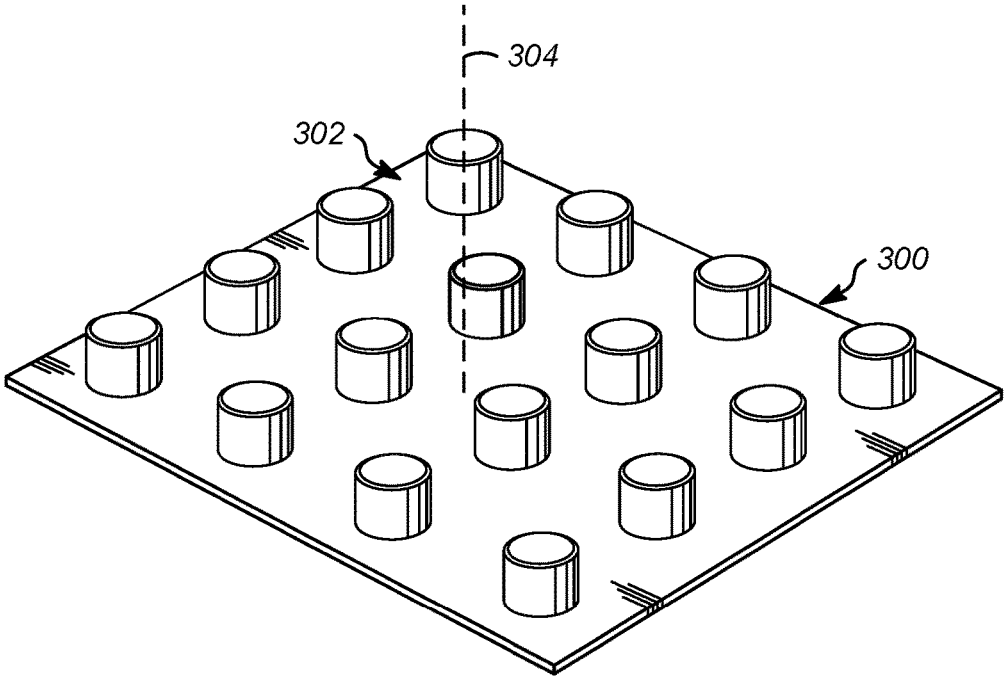
FIGS. 3A-3F, which visually depict the technique for assembly of the phased array antenna aperture.
Figure 3B:
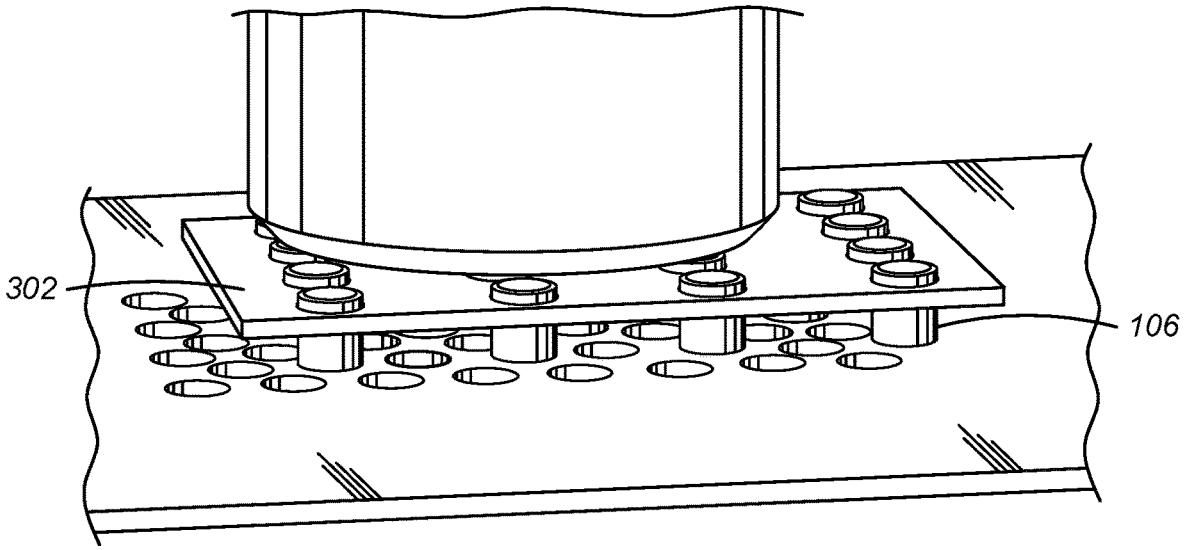
Figure 3C:
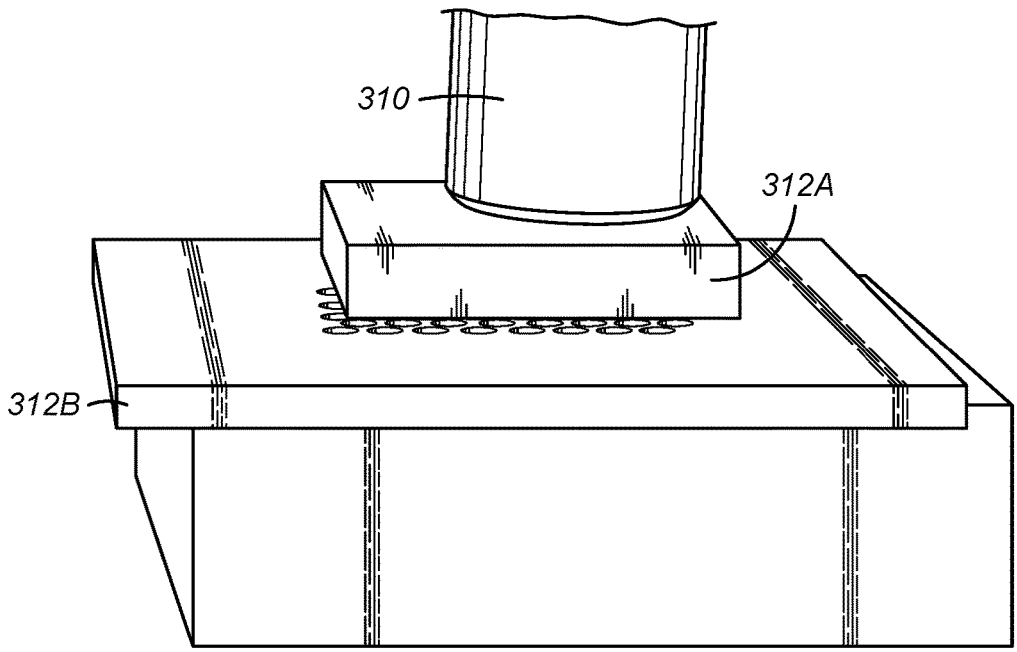
Figure 3D:
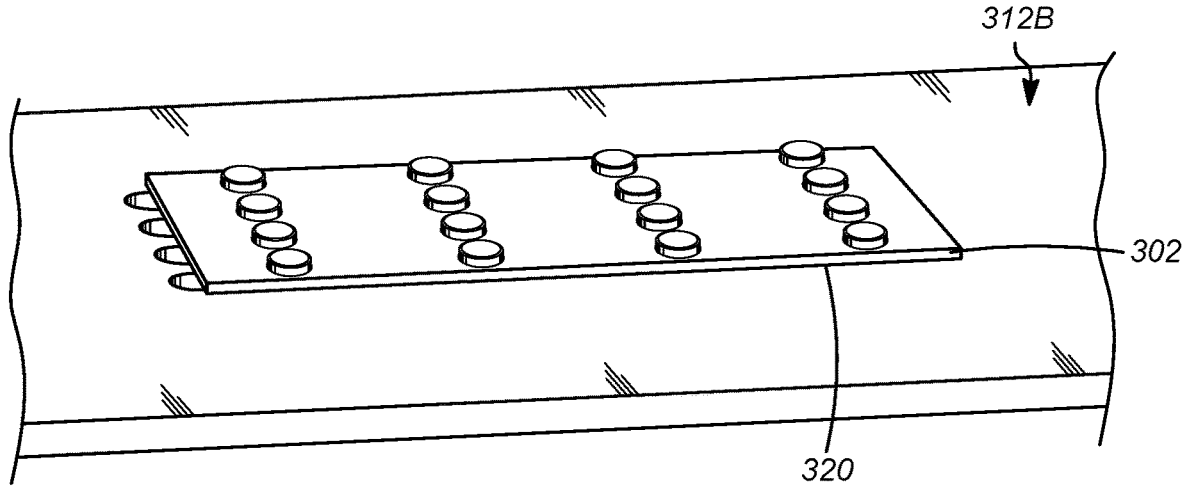

For example, the matrix 300 can be pressed into the plate 102 by repeated tapping of a mallet 310 evenly about the surface of the planar sacrificial interconnecting material 302, as shown in FIG. 3B.

In one embodiment, the cross section of one or more of the dielectric loads 106 in the matrix 300 may vary from end to end, in order to ease the insertion of the dielectric loads 106 into the respective aperture elements 104 of the plate 102 and to assure a precise fit. In a first embodiment, each of the dielectric loads 106 comprises one end that has a cross sectional dimension of slightly less than a respective cross-sectional dimension of the one of the aperture elements into which the dielectric load 106 is inserted. For example, the end of the dielectric load 106 that is inserted into the respective aperture element 104 may be chamfered to slightly less than the respective dimension of the aperture into which the dielectric load is inserted. This permits proper seating of the dielectric loads into their respective aperture elements.

At the same time, the remainder of the length of the dielectric loads 106 may be of a dimension slightly greater than the interior dimension of the aperture elements. In particular, an opposing end of the dielectric loads 106 proximate the planar sacrificial interconnecting material 302 may have a cross section that is slightly greater than that of the respective dimension of the one of the aperture elements 104 into which the dielectric load 106 is inserted. Consequently, the edges of the aperture elements 104 shear off some of the dielectric material on the external surface of one or more of the dielectric loads 106. This creates a precise diametrical fit, with the diameter of the dielectric loads 106 very closely matching the interior diameter of the aperture elements 104.

FIG. 2C is a diagram illustrating another embodiment of how the matrix 300 is inserted into the plurality of aperture elements 104. Preferably following seating of the dielectric loads 106 into their respective aperture elements 104, the matrix 300 and the aperture plate 102 are sandwiched between an upper tooling plate 312A and a lower tooling plate 312B, as described in block 242 and illustrated in FIG. 2C. Then, the matrix 300 is pressed into the aperture plate 102 until a first end of each dielectric load 106 extends completely through the associated aperture element 104 and contacts the lower tooling plate 312B, as shown in block 244.

In one embodiment, the length of the dielectric loads 106 along their longitudinal axis is chosen to be greater than the depth of the aperture elements 104 in the aperture plate 102 by an amount so that the dielectric loads 106 bottom out at the far (e.g. bottom) side of the aperture plate 200 and against the lower tooling plate 312B of the arbor press before the planar sacrificial interconnecting material 302 of the matrix 300 contacts the other (upper) side of the aperture plate. Since the dielectric loads 106 bottom out at the far side of the aperture plate 102 before the planar sacrificial interconnecting material contacts the aperture plate 102, a gap 320 is created between the planar interconnecting material and the aperture plate 102. This gap 320 provides space for the dielectric material sheared from the inserted dielectric loads to be deposited, and assures that such debris does not prevent the dielectric loads 106 from reaching the bottom of each of the aperture elements 104. The result is precise alignment of the dielectric loads 106 to the far side of the aperture plate 102. The gap 320 between the planar sacrificial interconnecting material 302 and the top of the aperture plate 102 illustrated in FIG. 3D.

Returning to FIG. 2A, the planar sacrificial interconnecting material 302 is then removed, as illustrated in block 206. In one embodiment, this comprises milling the side of the aperture plate 102 into which the dielectric loads are inserted to liberate the dielectric loads 106 by removing the planar sacrificial interconnecting material 302 and any debris sheared from each dielectric load 106.

Figure 3E:
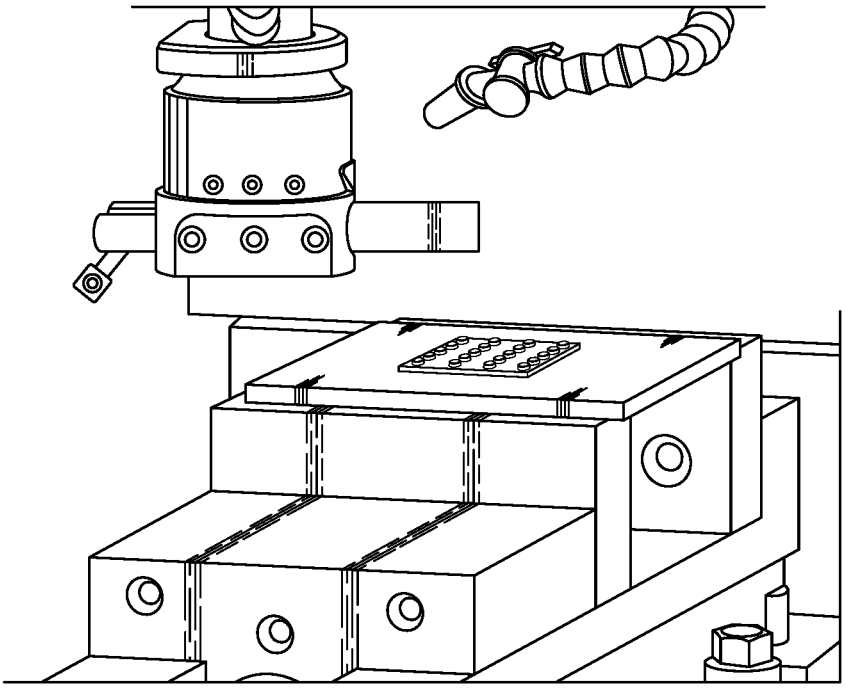

FIG. 3E is a diagram illustrating the machining off of the sacrificial planar interconnecting material from the top of the aperture plate 102. Approximately 0.002" of the aluminum may be removed from the aperture plate during the process. This creates a precision alignment from the dielectric loads 106 to aperture plate on the near side.

Figure 3F:
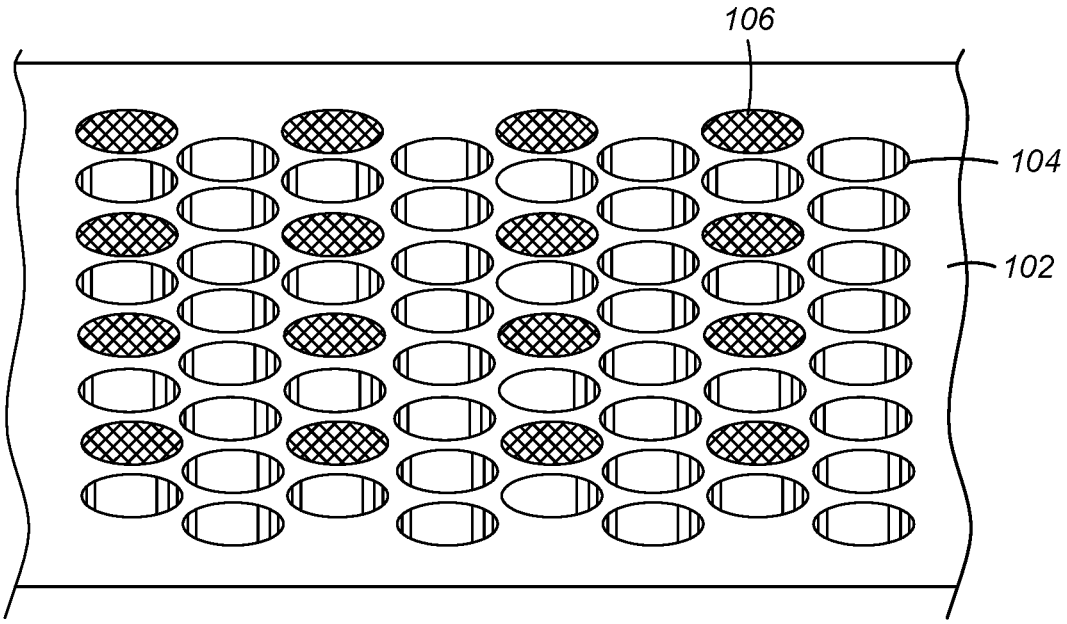

FIG. 3F is a diagram illustrating the aperture plate 102 having the liberated dielectric loads 106 inserted in the aperture elements 104 after the machining process. Note that the in the illustrated embodiment, the dielectric loads 106 in the matrix 300 were not adjacent to one another, and as a result, there are aperture elements 104 without inserted dielectric loads 106 interspersed between aperture elements 104 having dielectric loads. These now empty aperture elements 104 may have dielectric loads 106 inserted using the same process as described above, using a matrix 300 with dielectric loads 106 disposed to be inserted into these now empty aperture elements 104. In essence, with this technique, a particular area of the aperture plate 102 will have dielectric loads 106 inserted by more than one matrix 300. In this embodiment the milling process can be deferred until after all of the dielectric loads have been inserted, with the planar sacrificial material removed by other means.

Figure 4A:
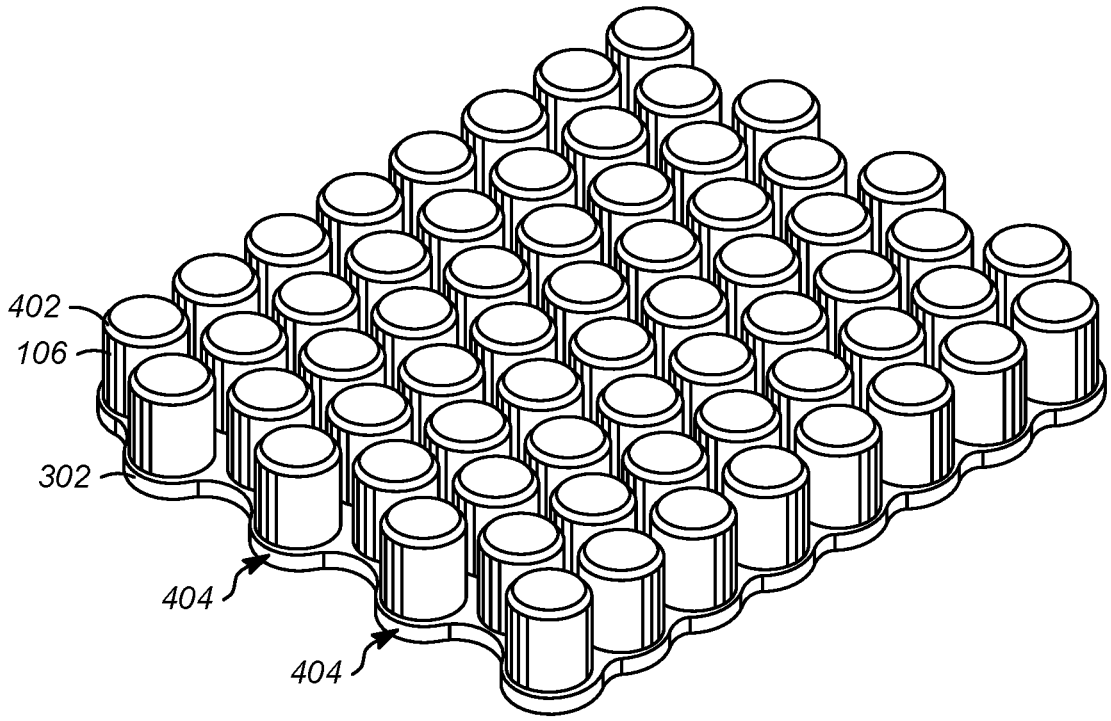
FIGS. 4A and 4B are diagrams of an embodiment of the matrix of triangularly disposed dielectric loads having chamfered ends.
Figure 4B:
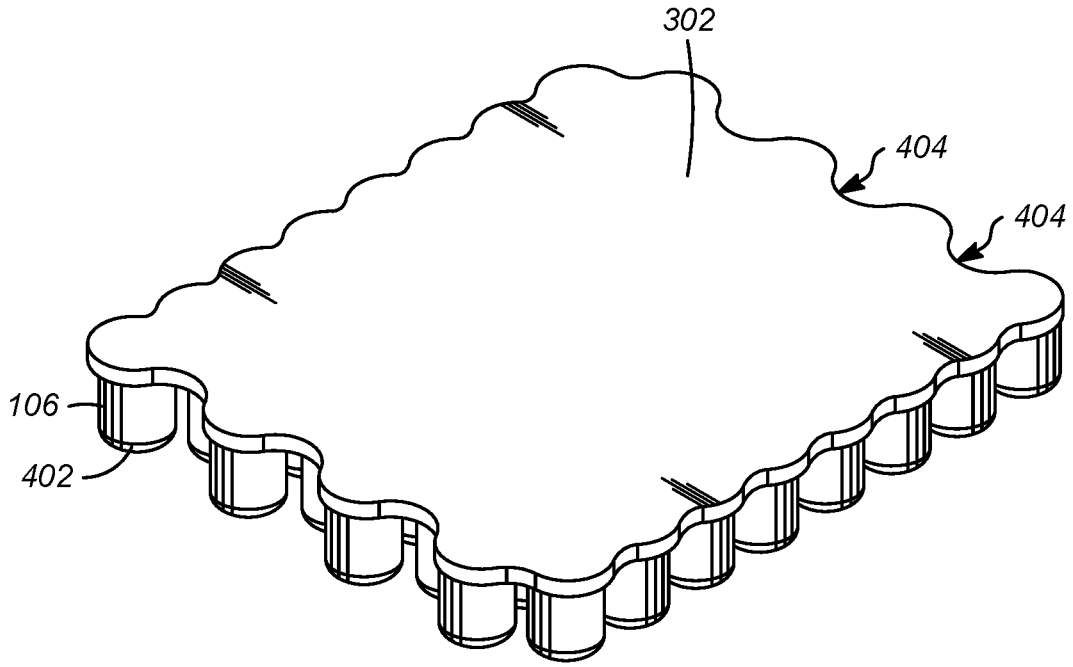

FIGS. 4A and 4B are diagrams of an alternative embodiment of the matrix 300 of dielectric loads 106. This embodiment of the matrix 300 includes 64 dielectric loads 106 and can be manufactured by conventional machining and then pressed into place in accordance with the foregoing process. Each dielectric load 106 the end 402 of the dielectric load 106 that is inserted into the aperture element 104 (distal from the end of the dielectric load 106 near the planar sacrificial interconnecting material 302) is chamfered to ease initial placement and insertion into the associated aperture element 104. The dielectric loads 106 are slightly oversized in diameter, so that upon further insertion until the chamfered end of the dielectric loads 106 are disposed against the lower tooling plate 312B (and hence coplanar with the bottom surface of the aperture plate 102), a small amount of sides of each dielectric load 106 is sheared off. This assures a snug and gapless fit. The planar sacrificial interconnecting material is then removed along with the debris that was sheared off in the insertion process. This can be accomplished by the machining process described above.

In this embodiment, the pattern of dielectric loads 106 of the matrix 300 matches the pattern of aperture elements 104 in the aperture plate 102, and the matrix 300 comprises a serpentine edge 404 interadjacently matching a serpentine edge of an adjacent matrix of a further subset of the dielectric loads 106. The serpentine edge extends a horizontal distance away from the dielectric loads 106 less than that of the distance between the dielectric loads 106 (and typically less than half that distance). This permits one matrix 300 of dielectric loads to be disposed adjacent another matrix of dielectric loads so that more than one matrix 300 of dielectric loads 106 can be inserted into the aperture elements 104 of the aperture plate 102 at one time.

Figure 5A:
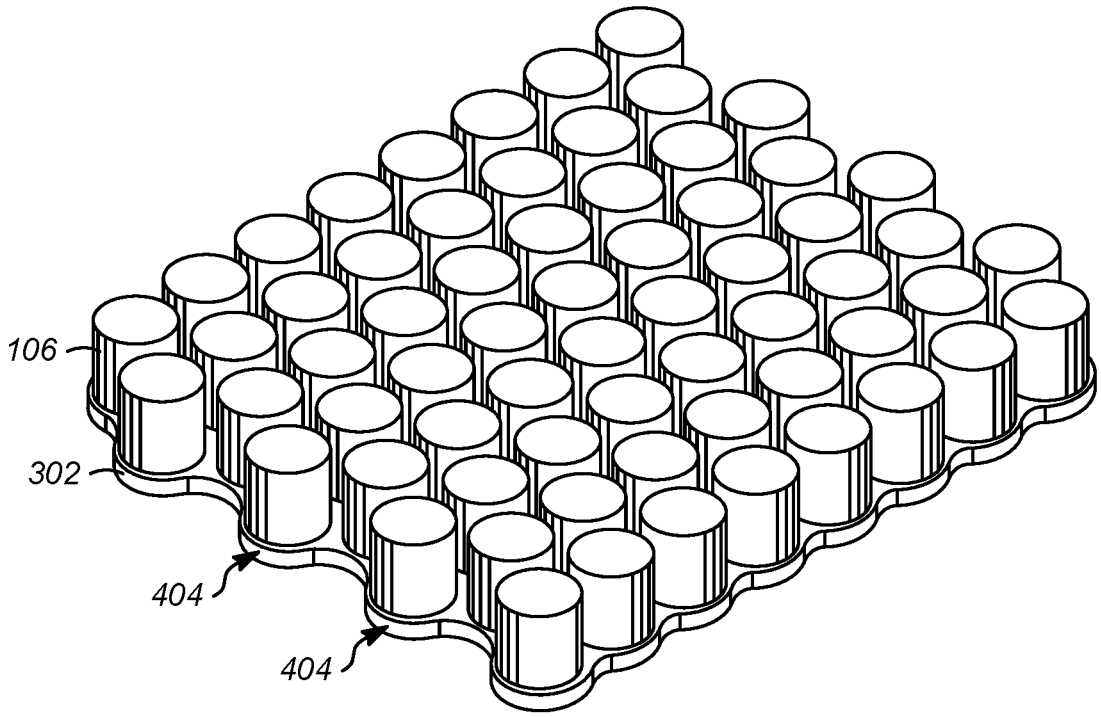
FIGS. 5A and 5B are diagrams illustrating an alternative embodiment of the matrix of triangularly disposed dielectric loads.
Figure 5B:
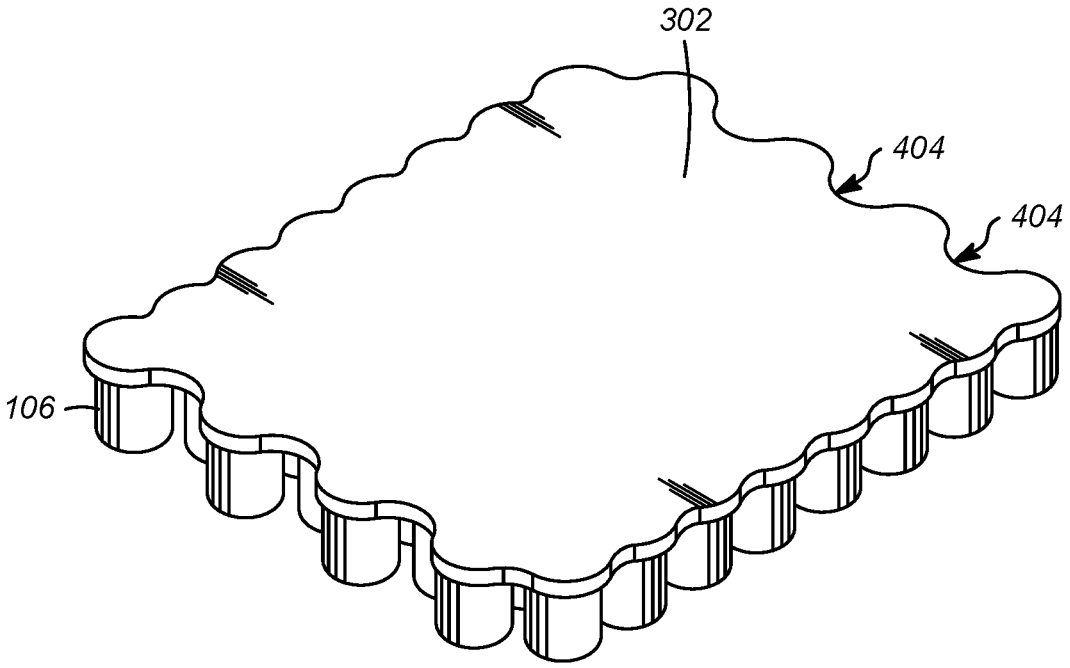

FIGS. 5A and 5B are diagrams illustrating another alternative embodiment of the matrix 300 of dielectric loads 106. This embodiment is identical to the embodiment shown in FIGS. 4A and 4B, except that it is intended for manufacture by injection molding. The dielectric loads 106 are still slightly oversize in diameter, but their sides have a 0.5 degree draft throughout the length of the dielectric load 106, rather than a chamfer at the end. In this configuration, the dielectric loads 106 are of a conic section shape. This enables ejection from a mold as well as insertion into the aperture plate 102.

Figure 6A:
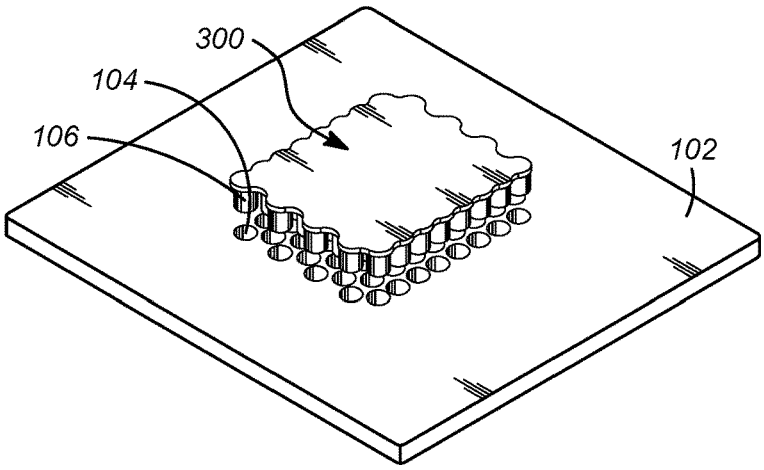
FIGS. 6A-6C are diagrams illustrating the process of disposing a matrix of dielectric loads joined by the planar sacrificial interconnecting material within associated aperture elements of the aperture plate, then machining away the interconnecting material to produce a final product.
Figure 6B:
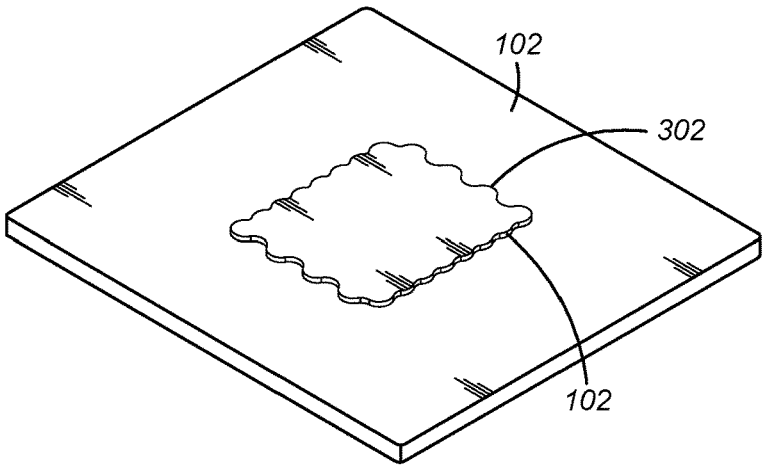
Figure 6C:
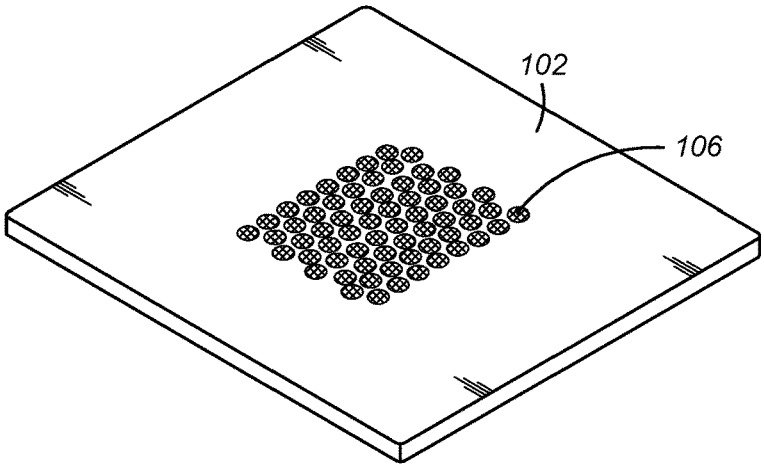

FIGS. 6A-6C are diagrams illustrating the process of disposing a matrix 300 of dielectric loads 106 joined by the planar sacrificial interconnecting material 302 within associated aperture elements 104 of the aperture plate 102, then machining away the interconnecting material 302 to produce a final product. FIG. 6A illustrates the placement of the matrix 300 adjacent the aperture plate 102, with each of the dielectric loads 106 disposed adjacent the associated aperture element 104 of the aperture plate 102. FIG. 6B illustrates the matrix 300 after insertion into the aperture plate 102, with the dielectric loads 106 disposed within the associated aperture elements 104, and a gap 320 between the planar sacrificial interconnecting material 302 and the top of the aperture plate 102. FIG. 6C is a diagram illustrating the PPA aperture 100 after the planar sacrificial interconnecting material 302 has been removed, leaving the dielectric loads 106 within the respective aperture elements 104.

Using this approach, touch labor is reduced by 64 times over the previous methods, a reduction of more than 98%. This savings is somewhat offset by the need for post-machining to remove the planar section, but the machining process can be easily automated.

FIGS. 6A-6C illustrate a matrix 300 having a single group of 64 dielectric loads 106 to be inserted into 64 aperture elements 104 or waveguide holes, the number of dielectric loads 106 in the matrix 300 may be more or less according to requirements. Further, dielectric loads 106 may be inserted into arrays with a greater number of aperture elements 104 by using a plurality of matrix 300 structures, as the serpentine edge of the matrix 300 allows for multiple such parts to fit together in a tiled fashion. Each matrix 300 may be pressed into a corresponding portion of the aperture plate 102 one at a time. After installation, all the planar sacrificial interconnecting material would be machined away at once.

Although it is typically desirable to include 2^n dielectric loads in a matrix 300 (wherein n is a positive integer), the matrix 300 may include any number of dielectric loads 106, and matrixes 300 with different numbers of plugs may be used with the same aperture plate 102.

Figure 7A:
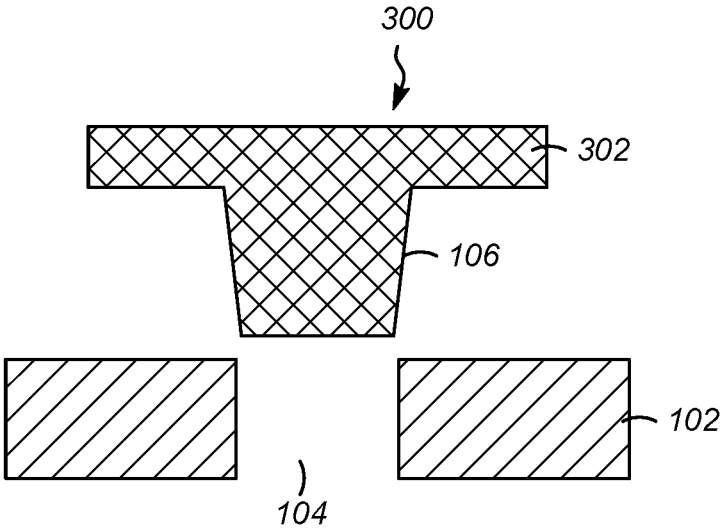
FIGS. 7A-7C are diagrams illustrating the insertion of the dielectric loads into the aperture elements of the aperture plate, showing the shearing of some of the dielectric load material from the aperture elements.
Figure 7B:
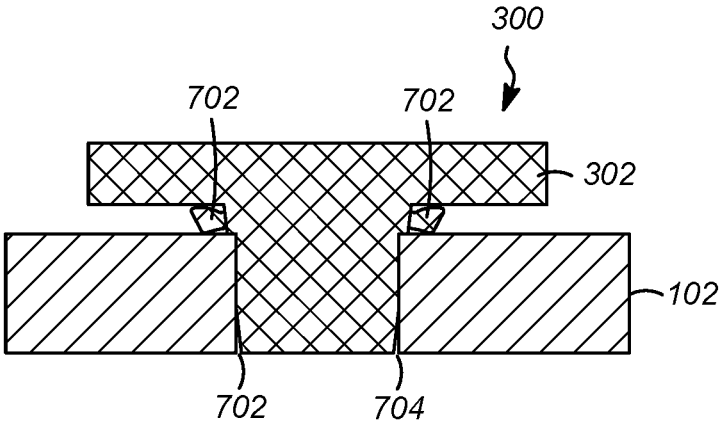
Figure 7C:
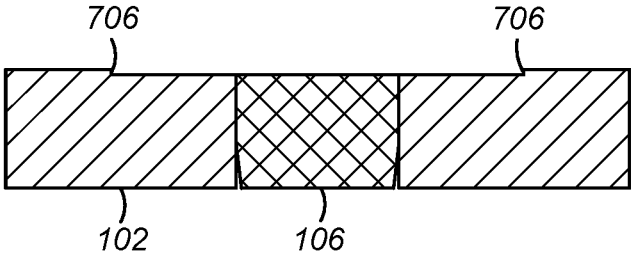

FIGS. 7A-7C are diagrams illustrating the insertion of the dielectric loads 106 into the aperture elements 104 of the aperture plate 102, showing the shearing of some of the dielectric load 106 material from the aperture elements 104. FIG. 7A illustrates a portion of the matrix 300 having a single dielectric load 106 centered over an aperture element 104 of the aperture plate 102. As the matrix 300 is pressed towards the aperture plate 102, the dielectric load 106 is urged within its associated aperture element 104. In the illustrated embodiment, the dielectric load has a small (e.g. 0.5 degree) draft, so the bottom of the dielectric load 106 is slightly narrower than the top of the dielectric load. This draft is exaggerated in FIG. 7A for purposes of illustration. As the matrix 300 is pressed towards the aperture plate 102, the upper edge of the aperture element 104 shears off the portion of the dielectric load 106 that exceeds the associated dimension of the aperture element 104, thus depositing debris 702 between the planar sacrificial interconnecting material 302 and the top of the aperture plate. This process continues until the leading end of the dielectric load 106 is pressed against the lower tooling plate 312B or similar structure, thus aligning the bottom surface of the dielectric load 106 with the bottom surface of the aperture plate 102. Since the dimension of the leading end of the dielectric load 106 is less than the associated dimension of the aperture element 104, one or more gaps 704 may remain between the dielectric load 106 and the aperture element 104. These gaps 704 are of a size that does not affect functional performance. FIG. 7C illustrates the structure after machining to remove the planar sacrificial interconnecting material 302 and the debris 702. Note that a small amount of the aperture plate 102 may also be removed in the machining process, resulting in a slight depression 706 in the aperture plate 102 in the surface area where the machining process occurred.

While the embodiments described above utilize dielectric loads 106 that are circular in cross section along their longitudinal axis, the dielectric loads 106 and the aperture elements 104 into which they are inserted may have other (but matching) cross sections. For example, each dielectric load 106 and the associated aperture element 104 may be rectangular, square, or elliptical in cross section.

Other embodiments utilize physical structures other than cylindrical dielectric loads 106 in a circular waveguide. Square dielectric loads 106 plugs can also be used in conjunction with a square waveguide, or rectangular dielectric loads 106 in a rectangular waveguide. Further, the waveguide elements need not be in a triangular lattice pattern, but may also be in a square lattice pattern or a rectangular lattice pattern.

Figure 8A:
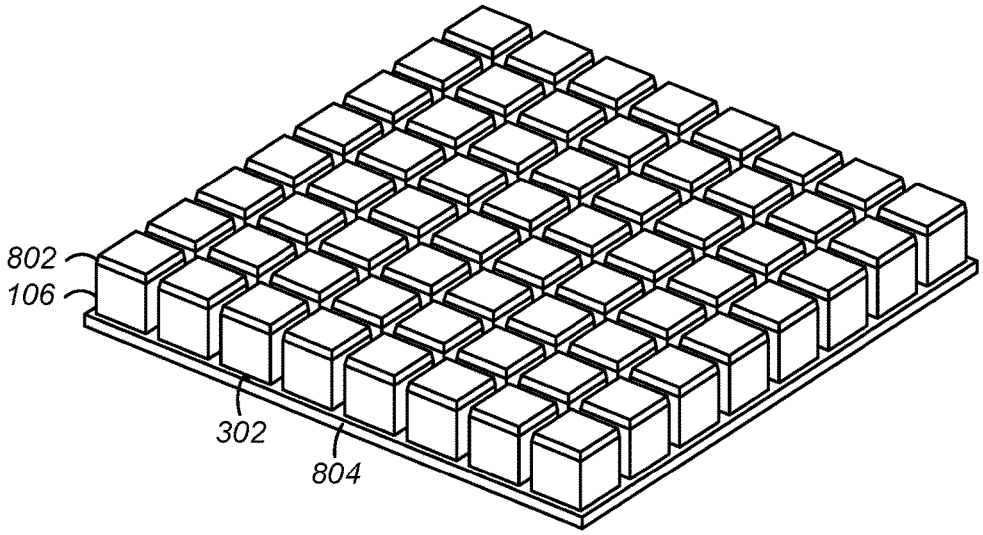
FIGS. 8A and 8B are diagrams of a further alternative embodiment of the matrix of dielectric loads having a rectangular or square cross section and chamfered ends.
Figure 8B:
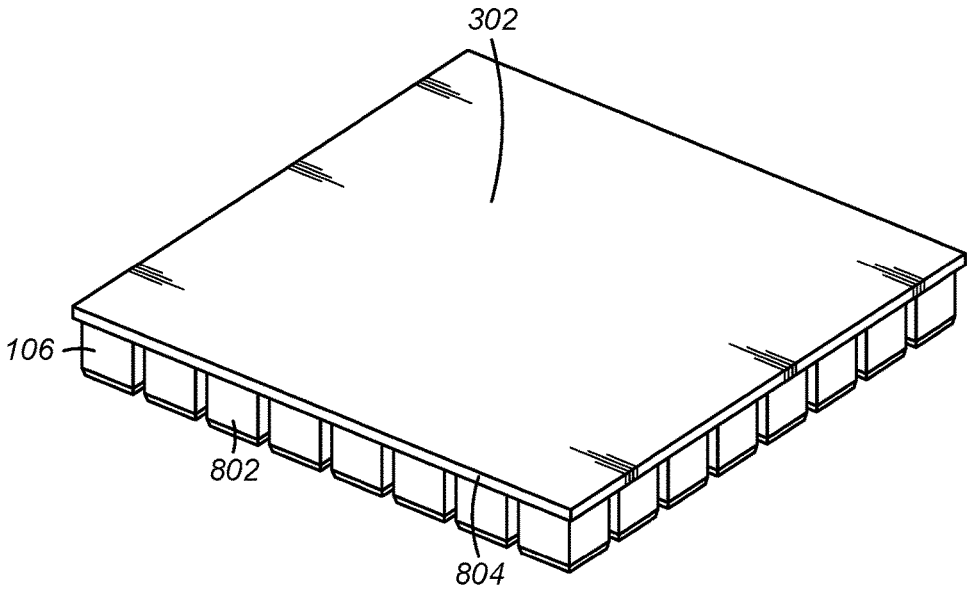

FIGS. 8A and 8B are diagrams of another alternative embodiment of the matrix 300 of dielectric loads 106. This embodiment of the matrix 300 includes 64 dielectric loads 106 of square or rectangular cross section, and can be manufactured by conventional machining and then pressed into place in accordance with the foregoing process. The end 802 of each dielectric load 106 that is inserted into the aperture element 104 (distal from the end of the dielectric load 106 near the planar sacrificial interconnecting material 302) is chamfered to ease initial placement and insertion into the associated aperture element 104. The dielectric loads 106 are slightly oversized in cross-section, so that upon further insertion until the chamfered end of the dielectric loads 106 are disposed against the lower tooling plate 312B (and hence coplanar with the bottom surface of the aperture plate 102), a small amount of sides of each dielectric load 106 is sheared off, again assuring a snug and gapless fit. The planar sacrificial interconnecting material is then removed along with the debris that was sheared off in the insertion process. Again, this can be accomplished by the machining process described above.

In this embodiment, the pattern of dielectric loads 106 of the matrix 300 matches the pattern of aperture elements 104 in the aperture plate 102, and the matrix 300 comprises a straight edge 804 interadjacently matching a straight edge of an adjacent matrix of a further subset of the dielectric loads 106. The edge extends a horizontal distance away from the dielectric loads 106 less than that of the distance between the dielectric loads 106 (and typically less than half that distance). This permits one matrix 300 of dielectric loads to be disposed adjacent another matrix of dielectric loads so that more than one matrix 300 of dielectric loads 106 can be inserted into the aperture elements 104 of the aperture plate 102 at one time.

Figure 9A:
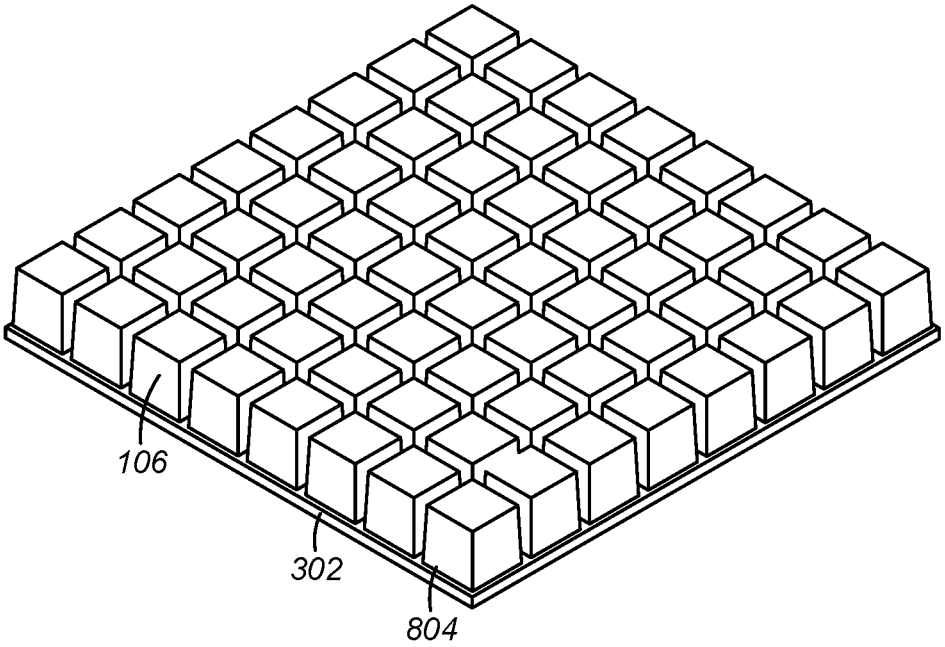
FIGS. 9A and 9B are diagrams illustrating a still further alternative embodiment of the matrix of dielectric loads having a rectangular or square cross section.
Figure 9B:
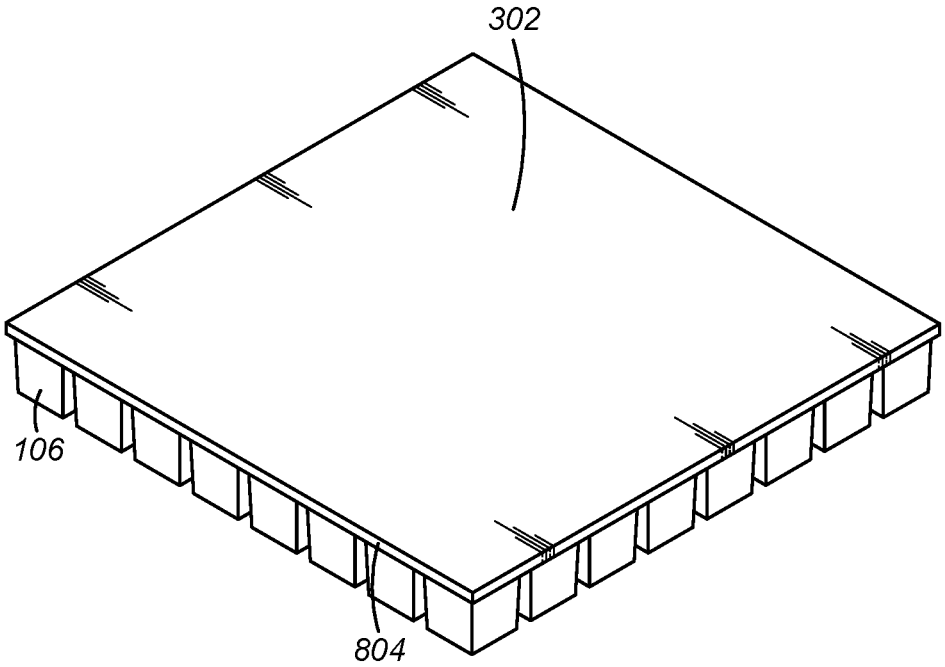

FIGS. 9A and 9B are diagrams illustrating another alternative embodiment of the matrix 300 of dielectric loads 106. This embodiment is identical to the embodiment shown in FIGS. 8A and 8B, except that it is intended for manufacture by injection molding. The dielectric loads 106 are still slightly oversize in diameter, but their sides have a 0.5 degree draft throughout the length of the dielectric load 106, rather than a chamfer at the end. In this configuration, the dielectric loads 106 are square or rectangular in cross-section. This enables ejection from a mold as well as insertion into the aperture plate 102.

Figure 10A:
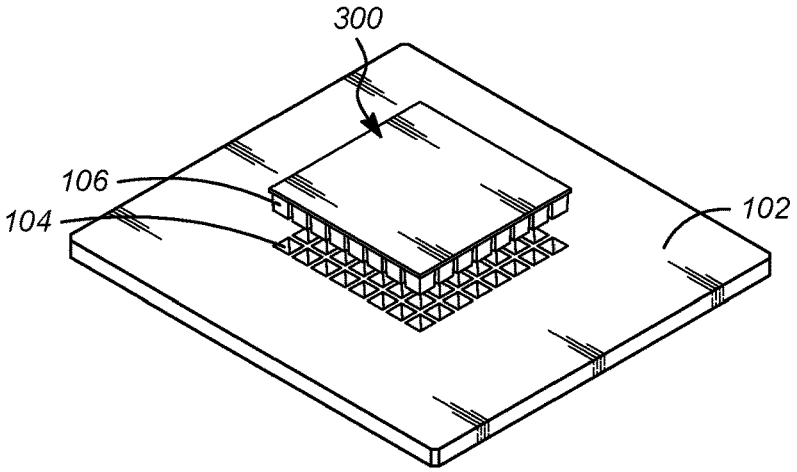
FIGS. 10A-10C are diagrams illustrating the process of disposing the matrix of dielectric loads of having square or rectangular cross section within associated aperture elements of the aperture plate, then machining away the interconnecting material to produce a final product.
Figure 10B:
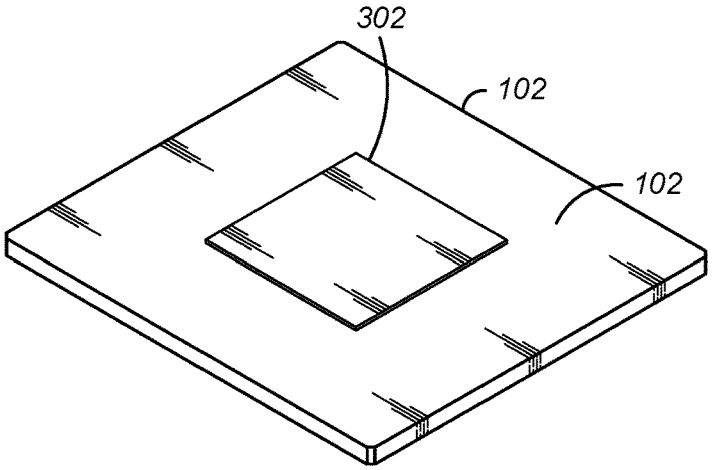
Figure 10C:
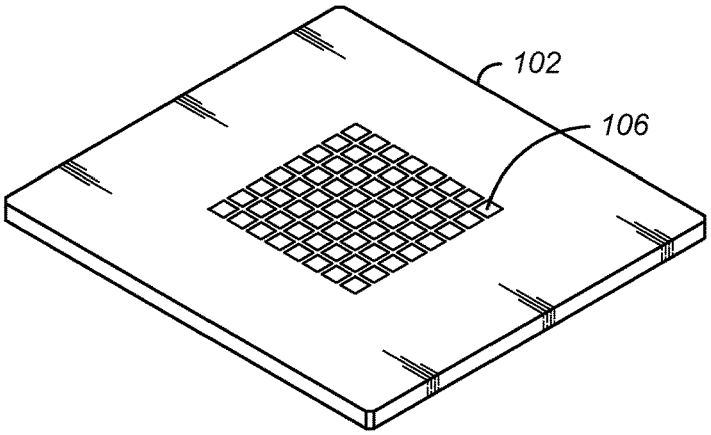

FIGS. 10A-10C are diagrams illustrating the process of disposing a matrix 300 of dielectric loads 106 joined by the planar sacrificial interconnecting material 302 within associated aperture elements 104 of the aperture plate 102, then machining away the interconnecting material 302 to produce a final product. FIG. 10A illustrates the placement of the matrix 300 adjacent the aperture plate 102, with each of the dielectric loads 106 disposed adjacent the associated aperture element 104 of the aperture plate 102. FIG. 10B illustrates the matrix 300 after insertion into the aperture plate 102, with the dielectric loads 106 disposed within the associated aperture elements 104, and a gap between the planar sacrificial interconnecting material 302 and the top of the aperture plate 102. FIG. 10C is a diagram illustrating the PPA aperture 100 after the planar sacrificial interconnecting material 302 has been removed, leaving the dielectric loads 106 within the respective aperture elements 104.

CONCLUSION

This concludes the description of the preferred embodiments of the present disclosure. The foregoing description of the preferred embodiment has been presented for the purposes of illustration and description. It is not intended to be exhaustive or to limit the disclosure to the precise form disclosed. Many modifications and variations are possible in light of the above teaching. It is intended that the scope of rights be limited not by this detailed description, but rather by the claims appended hereto.

What is claimed is:

1. A method of assembling an antenna comprising an aperture plate having a plurality of aperture elements therethrough, each aperture element having a dielectric load disposed therein, the method comprising:

forming a matrix of the at least a subset of the dielectric loads, each dielectric load having a longitudinal axis, the matrix of the at least the subset of the dielectric loads joined together by planar sacrificial interconnecting material perpendicular to a longitudinal axis of each dielectric load of the subset of dielectric loads;

inserting the matrix of the at least the subset of the dielectric loads in at least a subset of the plurality of aperture elements; and removing the planar sacrificial interconnecting material.

2. The method of claim 1, wherein:

each dielectric load of the matrix of the at least the subset of the dielectric loads comprises:

a cross section of slightly less than a respective dimension of the one of the aperture elements of the subset of the plurality of aperture elements into which the dielectric load is inserted at a first end of the dielectric load; and a cross section of a slightly greater than the respective dimension of the aperture element of the subset of the plurality of aperture elements into which the dielectric load is inserted at a second end of the dielectric load proximate the planar sacrificial interconnecting material.

3. The method of claim 2, wherein the first end of the dielectric load is chamfered to slightly less than the respective dimension of the aperture element into which the dielectric load is inserted.

4. The method of claim 2, wherein the dielectric load has a draft across a length of the dielectric load.

5. The method of claim 1, wherein:

each dielectric load of the matrix of the at least the subset of the dielectric loads is of a length along the longitudinal axis of greater than a depth of the respective aperture element in the aperture plate.

6. The method of claim 1, wherein inserting the matrix of the at least the subset of the dielectric loads in the plurality of aperture elements comprises:

seating each dielectric load of the matrix of the at least the subset of the dielectric loads in a respective aperture element of the aperture plate; and pressing the matrix of the at least the subset of the dielectric loads into the aperture plate.

7. The method of claim 6, wherein pressing the matrix of the at least the subset of the dielectric loads into the aperture plate comprises:

sandwiching the matrix of the at least the subset of the dielectric loads and the aperture plate between an upper tooling plate and a lower tooling plate; and pressing the matrix of at least a subset of the dielectric loads into the aperture plate until a first end of each dielectric load extends completely through the associated aperture element and contacts the lower tooling plate.

8. The method of claim 1, wherein each dielectric load of the matrix of the at least the subset of the dielectric loads are of a length along the longitudinal axis of greater than a depth of each respective aperture element in the aperture plate by an length to permit debris sheared from the dielectric load upon insertion of the matrix of the at least a subset of the dielectric loads in the plurality of aperture elements to be disposed between the planar sacrificial interconnecting material and the aperture plate before removing the matrix of the at least the subset of the dielectric loads in the plurality of aperture elements.

9. The method of claim 8, wherein removing the planar sacrificial interconnecting material comprises:

milling a side of the aperture plate into which the dielectric loads are inserted to remove the planar sacrificial interconnecting material and the debris sheared from each the dielectric load.

10. The method of claim 1, wherein:

the matrix of the at least the subset of the dielectric loads is formed by at least one of:

printing;

machining; and injection molding.

11. The method of claim 1, wherein:

the planar sacrificial interconnecting material comprises a serpentine edge interadjacently matching a serpentine edge of a second matrix of a further subset of the dielectric loads.

12. The method of claim 1, wherein:

each dielectric load and associated aperture element has a circular, rectangular, or square cross section.

13. The method of claim 1, wherein:

each dielectric load of the matrix of the at least the subset of the dielectric loads comprises a conic section having a first end having a first diameter and a second end having a second diameter smaller than the first diameter;

each aperture element of the subset of the plurality of aperture elements comprises a cross section matching a cross section of the dielectric load inserted into the aperture element; and the method further comprises:

placing an adhesive on at least one of each of the dielectric loads and the at least the subset of aperture elements before inserting the matrix of the at least the subset of the dielectric loads in the at least the subset of the plurality of aperture elements.

14. The method of claim 13, further comprising:

milling a side of the aperture plate opposite into which the dielectric loads are inserted.

15. A phased array antenna aperture, comprising an aperture plate having a plurality of aperture elements disposed therethrough, each of the plurality of aperture elements having a dielectric load disposed therein, the phased array antenna aperture produced by performing steps comprising the steps of:

forming a matrix of the at least a subset of the dielectric loads, each dielectric load having a longitudinal axis, the matrix of the at least the subset of the dielectric loads joined together by planar sacrificial interconnecting material perpendicular to a longitudinal axis of each dielectric load of the subset of dielectric loads;

inserting the matrix of the at least the subset of the dielectric loads in at least a subset of the plurality of aperture elements; and removing the planar sacrificial interconnecting material.

16. The phased array antenna aperture of claim 15, wherein:

each dielectric load of the matrix of the at least the subset of the dielectric loads comprises:

a cross section of slightly less than a respective dimension of the one of the aperture elements of the subset of the plurality of aperture elements into which the dielectric load is inserted at a first end of the dielectric load; and a cross section of a slightly greater than the respective dimension of the aperture element into which the dielectric load is inserted at a second end of the dielectric load proximate the planar sacrificial interconnecting material.

17. The phased array antenna aperture of claim 16, wherein the first end of the dielectric load is chamfered to slightly less than the respective dimension of the aperture element into which the dielectric load is inserted.

18. The phased array antenna aperture of claim 17, wherein the dielectric load has a draft across a length of the dielectric load.

19. The phased array antenna aperture of claim 15, wherein:

each dielectric load of the matrix of the at least the subset of the dielectric loads is of a length along the longitudinal axis of greater than a depth of the respective aperture element in the aperture plate.

20. The phased array antenna aperture of claim 15, wherein:

the aperture elements are arranged on any of a square lattice pattern, a rectangular lattice pattern, or a triangular lattice pattern.

* * * * *